US010427450B2

(12) United States Patent
Franco

(10) Patent No.: US 10,427,450 B2
(45) Date of Patent: Oct. 1, 2019

(54) MODULARLY STACKABLE DRY ERASE PANELS AND SYSTEM THEREOF

(71) Applicant: COMSERO, INC., Denver, CO (US)

(72) Inventor: Anthony Franco, Broomfield, CO (US)

(73) Assignee: COMSERO, INC., Denver, CO (US)

( * ) Notice: Subject to any disclaimer, the term of this patent is extended or adjusted under 35 U.S.C. 154(b) by 0 days.

(21) Appl. No.: 16/138,487

(22) Filed: Sep. 21, 2018

(65) Prior Publication Data

US 2019/0084342 A1 Mar. 21, 2019

Related U.S. Application Data

(60) Provisional application No. 62/561,570, filed on Sep. 21, 2017, provisional application No. 62/561,568, filed on Sep. 21, 2017, provisional application No. 62/561,550, filed on Sep. 21, 2017.

(51) Int. Cl.
*G09F 7/04* (2006.01)
*B43L 1/00* (2006.01)

(52) U.S. Cl.
CPC ..... *B43L 1/008* (2013.01); *G09F 7/04* (2013.01)

(58) Field of Classification Search
CPC ..... B43L 1/04; B43L 1/1045; G09F 7/04
See application file for complete search history.

(56) References Cited

U.S. PATENT DOCUMENTS 3,110,917 A 11/1963 Mcpeek
4,100,684 A 7/1978 Berger
4,207,646 A 6/1980 Osborne
4,415,092 A 11/1983 Boyer
4,875,591 A 10/1989 Mikesell
5,072,483 A 12/1991 Durand
5,269,083 A * 12/1993 Vampatella ..... A47G 1/065 248/206.5
5,432,973 A 7/1995 Wagner et al.
5,775,919 A * 7/1998 Gardner ..... B43L 1/04 40/594
5,836,038 A 11/1998 Thorp
5,947,304 A 9/1999 Thorp
6,007,891 A 12/1999 Davis et al.
6,056,468 A 5/2000 Niewiadomski
6,186,461 B1 2/2001 Pelaez
6,793,430 B1 9/2004 Liu
7,309,181 B2 12/2007 Hawkins
7,967,520 B2 6/2011 Hawkins
8,032,966 B1 10/2011 Keller
D663,776 S 7/2012 Lira-Nunez et al.
D669,937 S 10/2012 Lira-Nunez et al.
9,409,437 B2 8/2016 Green et al.
2008/0120922 A1* 5/2008 Sullivan ..... G09F 7/18 52/38
2008/0166173 A1 7/2008 Gibbons
2009/0193629 A1* 8/2009 Suenaga ..... G09F 1/10 24/303

(Continued)

*Primary Examiner* — Gary C Hoge
(74) *Attorney, Agent, or Firm* — Hall Estill Law Firm

(57) ABSTRACT

The preferred embodiment of the present invention comprises a stackable and modularly reconfigurable device and system providing a surface for marking and displaying items. More specifically, embodiments of the invention relate to a modularly reconfigurable device and system having erasable writing surfaces with interconnection features.

1 Claim, 4 Drawing Sheets

(56) References Cited

U.S. PATENT DOCUMENTS

| | | | | |
|---|---|---|---|---|
| 2009/0250575 | A1* | 10/2009 | Fullerton | G09F 7/04 248/206.5 |
| 2010/0068422 | A1* | 3/2010 | Keyes | G09F 7/04 428/13 |
| 2013/0074299 | A1* | 3/2013 | Rojdev | A61G 17/04 27/14 |
| 2014/0377736 | A1* | 12/2014 | Essen | B43L 1/008 434/408 |
| 2016/0073796 | A1* | 3/2016 | Nesbitt | A47G 1/065 40/711 |

* cited by examiner

MODULARLY STACKABLE DRY ERASE PANELS AND SYSTEM THEREOF

CROSS REFERENCE TO RELATED APPLICATIONS

This application claims the benefit of U.S. Provisional Patent Application 62/561,550, filed on Sep. 21, 2017, which is hereby incorporated by reference in its entirety. This application claims the benefit of U.S. Provisional Patent Application 62/561,570, filed on Sep. 21, 2017, which is hereby incorporated by reference in its entirety. This application claims the benefit of U.S. Provisional Patent Application 62/561,568, filed on Sep. 21, 2017, which is hereby incorporated by reference in its entirety.

FIELD OF THE INVENTION

The present invention relates to a stackable and modularly reconfigurable device and system providing a surface for marking and displaying items. More specifically, the present invention relates to a modularly reconfigurable device and system having erasable writing surfaces with interconnection features.

BACKGROUND OF THE INVENTION

Dry erase boards provide a surface for erasable writing surface to leave little or no visible residue when erased. Dry erase boards have become a widely accepted tool of written and graphic communication, or written content, for entities such as corporations, teaching institutions, and creative groups. Technologies enabling the erasable writing surface of dry erase boards are known to persons of ordinary skill in the art. A dry erase board typically includes a board or substrate having a surface treated with an enamel, film, ultraviolet cured liquid, liquid varnish, or porcelain finish. The substrate is affixed to a structure allowing individuals to write on it with specially designed markers. While the ink of the marker dries on the substrate, the ink does not bond to the substrate surface and the writing can be easily removed with a soft eraser, cloth, finger, etc.

The rapid drying nature of the ink of the specially designed markers provides users with a rapidly editable product which has become widely accepted for collaborative and brain storming sessions as well as other scenarios which may benefit from such characteristics.

Some collaborative and brain storming activities, sometimes referred to as ideation, still use separate technologies enabling such activities. An activity surrounding collaborative thinking, brainstorming or ideation commonly use adhesive-backed notes, such as Post-It® notes. Adhesive-backed notes are small pieces of paper with an adhesive strip allowing a user to document a thought, list or other noteworthy information and temporarily adhere it to a surface. In brainstorming, adhesive-backed notes allow communication of by way of displaying content on a communal board. In some circumstances, a first note having similar content to a second note, may be removed and co-located with the second note. Sometimes it may be preferred to place the first note beside the second note, in other situations it may be preferred to place the first note such that it overlaps or completely conceals the second note.

The use of adhesive-backed notes and the like for brainstorming, albeit effective, creates unnecessary waste. Therefore, there is an identified need for erasable writing surfaces configured to have functionality similar to that of adhesive-backed notes and the like.

SUMMARY OF THE INVENTION

It is an aspect of the present invention to provide erasable writing surfaces which allow a user to use erasable writing surfaces, such as dry erase boards in a manner which is substantially similar to the use of adhesive-backed notes.

The following references related to wall hanging an object are hereby incorporated by reference in their entireties: U.S. Pat. No. 7,128,798 to Boudouris, et al. ("the '798 reference"), surrounding magnetic substrates, composition and methods for making the same; U.S. Pat. No. 7,338,573 to Boudouris ("the '573 reference"), surrounding magnetic substrates with high magnetic loading; and U.S. Patent Application Publication No. 2006/0222858 to Haas ("Haas"), surrounding flexible dry-erase and instructional magnets. Each of the above referenced patent publications surround the application of sheet magnets to a first surface of a substrate. Haas particularly points out the application of a dry erase layer to a magnetic substrate resulting a dry erase layer which can be removably affixed to a magnetically attractable surface. Haas further discloses his dry erase magnet to result in a stack-able magnet surface for dry erase marking. However, the stacking of a first dry erase magnet on top of a second dry erase magnet of Haas, would likely result in the disfiguring of content. This disfiguring occurs when placing the first dry erase magnet atop the second dry erase magnet, or when removing the first dry erase magnet from the second dry erase magnet.

It is a further aspect of the present invention to provide a first erasable writing surface which can be removably affixed to a second erasable writing surface without disfiguring the content displayed on the second erasable writing surface.

Certain embodiments of the present invention comprise a magnet affixed to a rear surface of a panel such that the magnet protrudes from the rear surface of the panel. In certain embodiments, a first magnet is embedded within the thickness of a panel with a first end of the magnet protruding from the rear surface of the panel. The protrusion of a first end of a magnet from the rear surface of the panel allows the panel to be affixed to a magnetically attractable surface without disfiguring content on the magnetically attractable surface. In certain embodiments, a second end of a magnet is embedded within the thickness of the panel, proximally located to a front surface of the panel. A magnetically attractable material of various embodiments include, but are not limited to, ferromagnetic materials including iron, nickel, cobalt and some alloys of rare-earth metals.

Certain embodiments of the invention comprise a magnet embedded into a panel. In such embodiments, the panel lacks a recess. The present inventor recognizes the advantage of such embodiment that such a panel is stackable on other panels without the need for alignment of a protrusion of one panel to a recess of another panel. In an embodiment, the polarity of the magnets of one panel relative to the magnets of another panel are configured such that the panels will not stack in any direction other than the orientation caused by the forces generated by the magnets in each panel. In an embodiment of the invention, the magnets cause the panels to orient in the same direction as the orientation of a tablet as disclosed in U.S. Provisional Patent Application 62/561,550 filed on Sep. 21, 2017, which is incorporated by reference in its entirety.

Various embodiments of the present invention surround a system having a first panel and a second panel. The first panel has an affixed first magnet such that a north pole of the first magnet protrudes from the rear surface of the first panel. A south pole of the first magnet is embedded within the thickness of the first panel proximal to the front surface of the first panel. The second panel has an affixed first magnet such that a north pole of the first magnet protrudes from the rear surface of the second panel. A south pole of the first magnet of the second panel is embedded within the thickness of the second panel proximal to the front surface of the second panel. Thus, the first panel may be affixed to a front surface of the second panel. Aligning the north pole of the first magnet of the first panel to the south pole of the first magnet of the second panel affixes the first panel to the second panel with increased retention. It will be appreciated by a person having ordinary skill in the art that the polarity of the magnets of the first panel and second panel may be reversed while keeping with the spirit and scope of the present invention.

In certain embodiments, a first panel has an affixed magnet, and a second panel has a magnetically attractable surface. Thus, the first panel may be affixed to the second panel by disposing a first magnet of the first panel against the magnetically attractable surface of the second panel.

Various embodiments of the present invention disclosed herein allow for the stacked, or stagger-stacked fixation of a first panel to a second panel. It will be appreciated that a stagger-stacked configuration of elements surrounds a first element overlapping a portion of a second element, thus exposing surfaces of both the first element and the second element.

Certain embodiments of the present invention surround a system having panels for mating with a magnetically attractable substrate. In certain embodiments, a magnetically attractable substrate may further comprise integrated magnets for alignment, to provide confirmation of alignment of a tablet to the surface in a predetermined array configuration. Such magnets for alignment provide increased retention of tablets and provide a predetermined array configuration having a pleasing aesthetic.

A system, in certain embodiments, comprises a magnetically attractable substrate having a dry erase surface. Alignment magnets are integrated into the substrate such that a first surface of the alignment magnet is consistent with or proximal to the dry erase surface. Thus, when a magnet of a panel is placed upon the magnetically attractable surface, it is removably affixed to the dry erase surface. A user may slidably align a magnet of a panel with an alignment magnet, thus resulting in increased fixation of the panel to the substrate at the point of the first alignment magnet.

These and other advantages will be apparent from the disclosure of the inventions contained herein. The above-described embodiments, objectives, and configurations are neither complete nor exhaustive. As will be appreciated, other embodiments of the invention are possible using, alone or in combination, one or more of the features set forth above or described in detail below. Further, this Summary is neither intended nor should it be construed as being representative of the full extent and scope of the present invention. The present invention is set forth in various levels of detail in this Summary, as well as in the attached drawings and the detailed description below, and no limitation as to the scope of the present invention is intended to either the inclusion or non-inclusion of elements, components, etc. in this Summary.

Additional aspects of the present invention will become more readily apparent from the detailed description, particularly when taken together with the drawings, and the claims provided herein.

BRIEF DESCRIPTION OF THE DRAWINGS

FIG. 1B—A rear view of certain embodiments of a panel

FIG. 1C—A side cross sectional view of certain embodiments of a panel

FIG. 2B—A perspective view of certain embodiments of a system

DETAILED DESCRIPTION OF VARIOUS EMBODIMENTS

As described below, embodiments of the present invention surround a panel 1000 providing a surface for erasable writing and configurations comprising mounting features, interconnection features and/or other features. It is the applicant's intent that this specification and the claims appended here to be accorded a breadth in keeping with the scope and spirit of the invention being disclosed despite what might appear to be limiting language imposed by the requirements of referring to the specific examples disclosed.

Figure 1A:
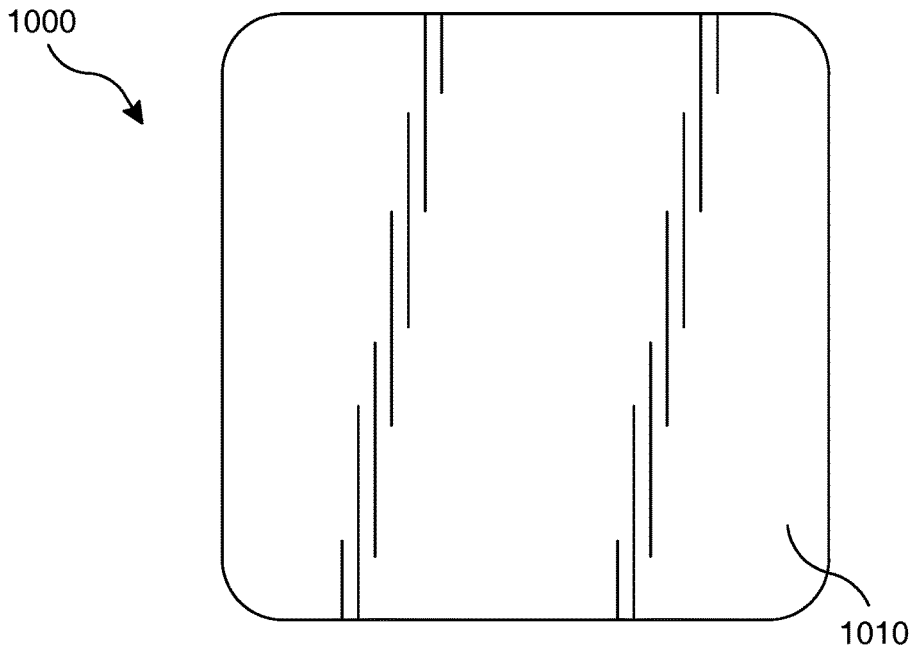
FIG. 1A—A front view of certain embodiments of a panel
Figure 1B:
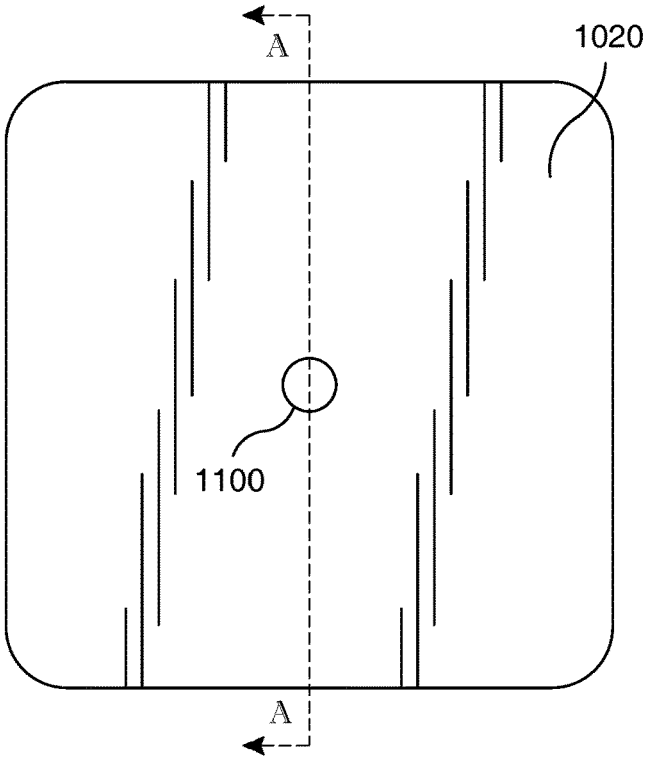
Figure 1C:
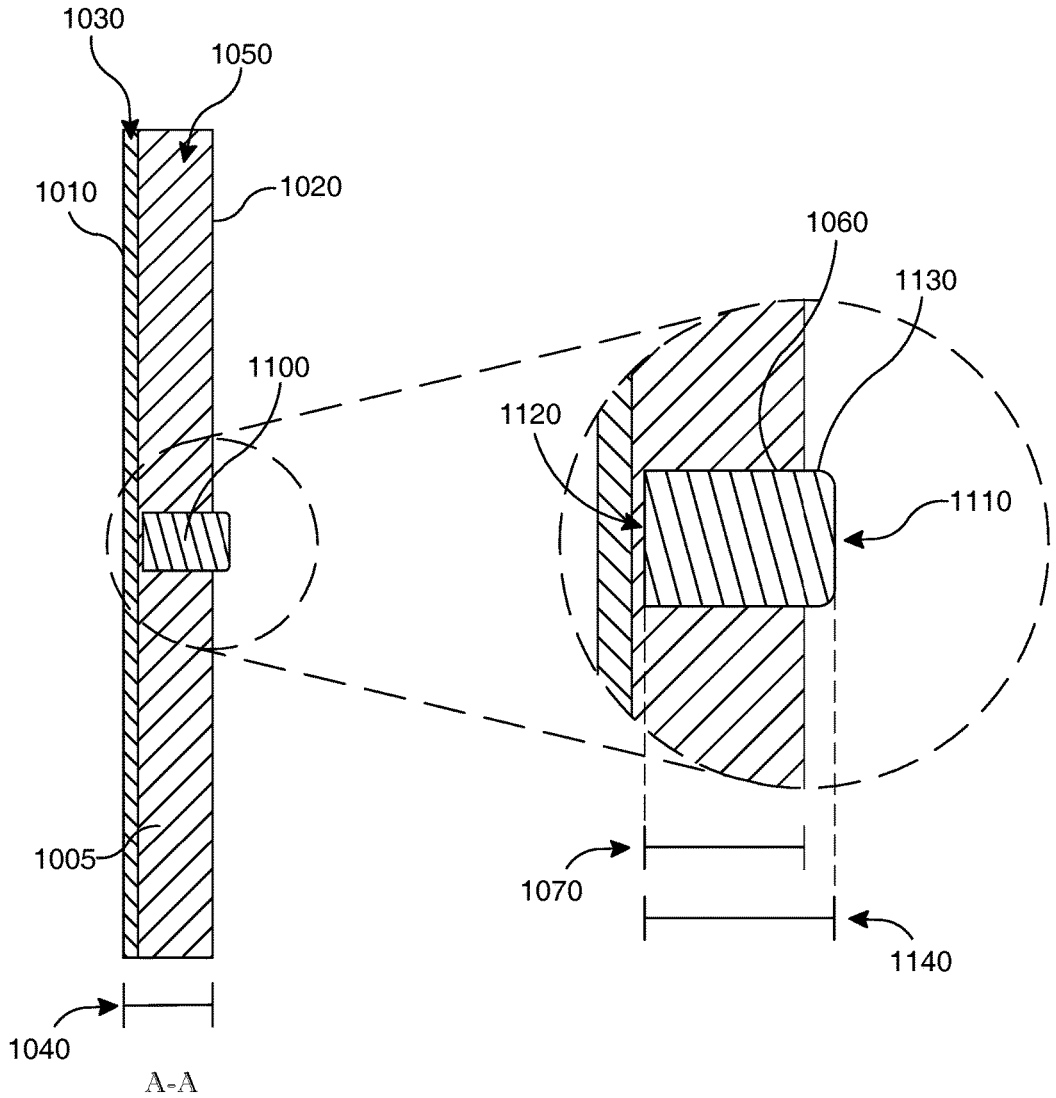

Certain embodiments of the present invention, shown in FIG. 1A and FIG. 1B, comprise a panel 1000 having a first surface 1010 and a second surface 1020. The first surface 1010 of certain embodiments comprises a surface treatment 1030 (FIG. 1C). Surface treatments 1030, as directed to the present invention include a dry erase surface or a chalk board surface. However, the embodiments of the present invention are not limited to the above-mentioned surface treatments and may include other surface treatments providing an erasable writing surface and/or magnetically attractable surface. In certain embodiments, a panel 1000 comprises a substantially square shape. However, it will be appreciated that embodiments may comprise a panel 1000 having a shape other than a square while remaining in scope and spirit of the present invention. A panel 1000, in various embodiments, comprises a first magnet 1100 affixed to the second surface 1020 of the panel 1000.

In certain embodiments, shown in FIG. 1C, a panel 1000 comprises a first surface 1010 having a surface treatment and a second surface 1020. A first magnet 1100 is affixed to the panel 1000 such that a first end 1110 of the first magnet protrudes from the second surface 1020 of the panel. In an alternative embodiment, the first magnet 1100 is embedded between the first surface 1010 and the second surface 1020.

In certain embodiments, shown in FIG. 1C, the first magnet 1100 further comprises a second end 1120 embedded into a thickness 1040 of a panel such that a second end 1120 of the first magnet is proximal to the first surface 1010 of the panel. In various embodiments, a magnet 1100 is embedded into the thickness 1040 of the first panel using a recess 1060 consistent with the second surface 1020 of the panel. The recess 1060 comprises a profile configured to receive the magnet. In certain embodiments, the recess 1060 is configured to mate with an outer surface 1130 of the magnet resulting in an engineering fit. An engineering fit will be appreciated to surround a location fit, press fit, interference fit, RC fit, or other engineering fit such as those specified by ANSI B4.1 (Standard Tolerance Limits and Fits), incorporated by reference herein. It will be further appreciated that other engineering fits or assembly strategies known to those skilled in the art may be used while in keeping with the scope and spirit of the present invention. It will be further appreciated that a magnet 1100 may be affixed to a panel using means in the prior art, such as by adhesive fixation or overmolding. In an alternative embodiment, a magnet 1100 may be affixed to the interior of the first surface 1010 and/or the second surface 1020 such that the magnet 1100 is embedded between the first surface 1010 and the second surface 1020.

In certain embodiments, shown in FIG. 1C, a panel 1000 has a recess 1060 with a magnet 1100 disposed within the recess 1060. The recess 1060 has a depth 1070 less than the thickness 1040 of the panel, and the magnet 1100 has a length 1140 greater than the depth 1070 of the recess 1060. The recess 1060 is configured to receive the magnet 1100, allowing the fixation of the magnet 1100 within the recess 1060. A first end 1110 of the magnet protrudes from the second surface 1020 of the panel and a second end 1120 of the magnet is disposed within the recess. In certain embodiments, a recess 1060 may have a depth 1070 equal to the thickness 1040 of the panel.

Figure 2A:
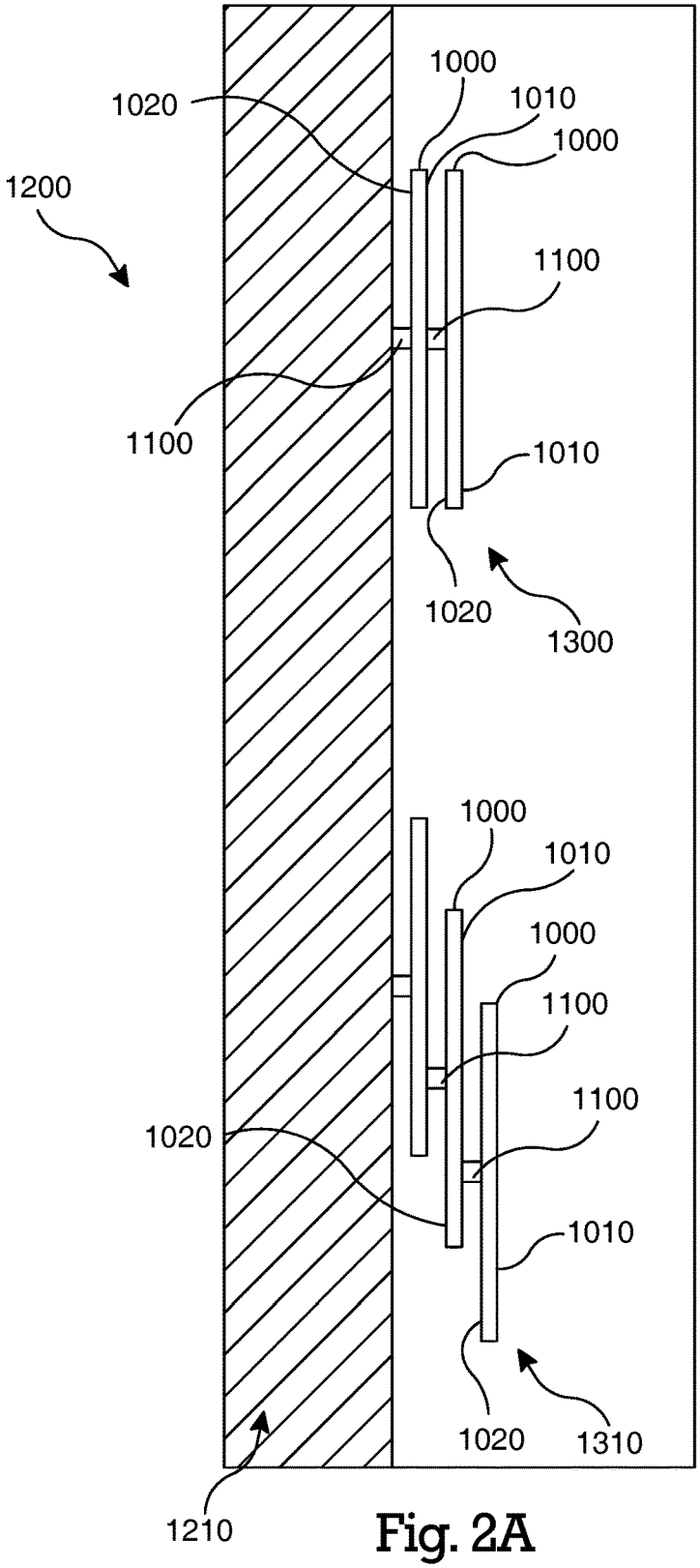
FIG. 2A—A side view of certain embodiments of a system

Certain embodiments of the present invention, shown in FIG. 2A, are directed to a system 1200 comprising a first panel 1000, as shown in FIG. 1C, having a first surface 1010, a second surface 1020 and a first magnet 1100. The system 1200, referencing FIG. 2A, further comprises a second panel 1000 having a first surface 1010 and a second surface 1020. The first surface 1010 of the second panel comprises a magnetically attractable material such that disposing the first magnet 1100 of the first panel to the first surface 1010 of the second panel results in the fixation of the first panel 1000 to the second panel 1000. It will be appreciated that a first panel 1000 and a second panel 1000 of the present embodiment may be connected in a stacked configuration 1300 or stagger-stacked configuration 1310 as shown in FIG. 2A and FIG. 2B.

Figure 2B:
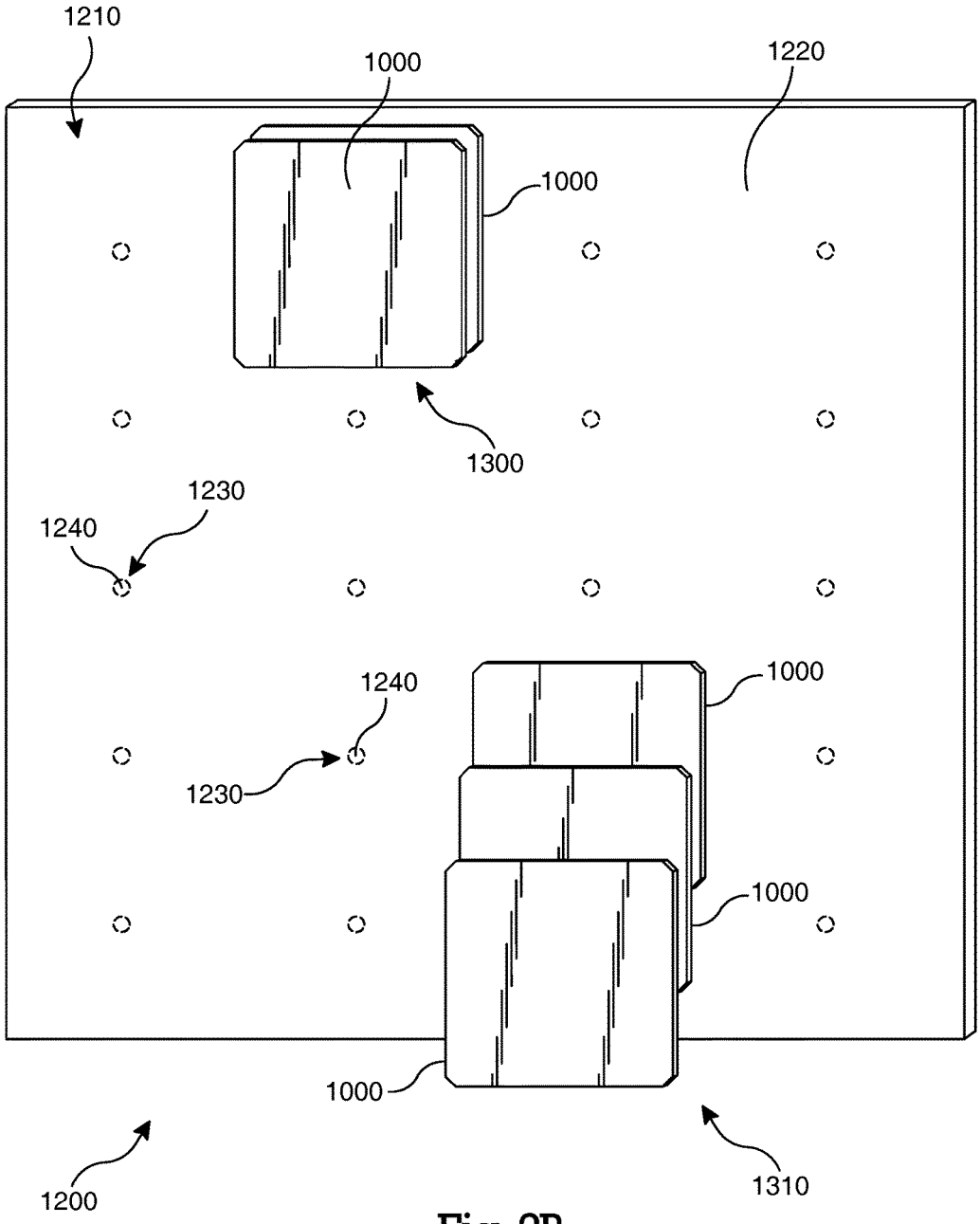

Certain embodiments of a system 1200, shown in FIG. 2B, comprise a substrate 1210 having a magnetically attractable first surface 1220. In certain embodiments, a substrate 1210 comprises a first alignment magnet 1230. In certain embodiments, shown in FIG. 2B, a substrate 1210 comprises a plurality of alignment magnets 1230. A first alignment magnet 1230 is combined with the substrate 1210 such that a first end 1240 of the first alignment magnet 1230 is consistent with or recessed from the first surface 1220 of the first substrate, thus providing an uninterrupted first surface 1220 of the substrate. An uninterrupted first surface 1220 of the substrate allows the unfettered slidable rearrangement of a panel 1000 on the first surface 1220. The connection of a first magnet of a first panel 1000 to a first surface 1220 results in the retention of the first panel 1000 to the substrate 1210. The alignment of a first magnet of a first panel 1000 with a first alignment magnet 1230 provides for increased retention of the first panel to the substrate 1210.

It will be appreciated that in embodiments, referencing FIG. 1C and FIG. 2B which the first end 1110 of a first magnet protrudes from a first panel 1000 for fixation to a magnetically attractable surface 1220, the first end 1110 of the magnet comprises a north pole. A first end 1240 of an alignment magnet consistent with a first surface 1220 of a substrate comprises a south pole. Alternatively, embodiments in which the first end 1110 of a first magnet comprises a south pole, a first end 1240 of an alignment magnet comprises a north pole.

While various embodiments of the present invention have been described in detail, it is apparent that modifications and alterations of those embodiments will occur to those skilled in the art. However, it is to be expressly understood that such modifications and alterations are within the scope and spirit of the present invention. Further, the inventions described herein are capable of other embodiments and of being practiced or of being carried out in various ways. In addition, it is to be understood that the phraseology and terminology used herein is for the purposes of description and should not be regarded as limiting. The use of "including," "comprising," or "adding" and variations thereof herein are meant to encompass the items listed thereafter and equivalents thereof, as well as, additional items.

What is claimed is:

1. A system comprising:

a first panel having a first surface comprising a magnetically attractable surface, a second surface, and a magnet protruding from the second surface;

a second panel having a first surface comprising a magnetically attractable surface, a second surface, and a magnet protruding from the second surface; and a first substrate comprising a magnetically attractable material having a first alignment magnet with a first end of the first alignment magnet consistent with a first surface of the first substrate, wherein the connection of the first magnet of the first panel with the first substrate results in the magnetic fixation of the first panel to the substrate, and the connection of the first magnet of the second panel to the first surface of the first panel affixes the second panel to the first panel, and wherein connection of the first magnet of the first panel to the first surface of the first substrate in alignment with the first alignment magnet results in the increased fixation of the first panel to the first substrate, and the connection of the first magnet of the second panel to the first surface of the first panel in alignment with the first magnet of the first panel affixes the second panel to the first panel in a stacked configuration.

* * * * *